US010228204B1

(12) United States Patent
Healy

(10) Patent No.: US 10,228,204 B1
(45) Date of Patent: Mar. 12, 2019

(54) MECHANICAL FIREARM SAFETY SYSTEM

(71) Applicant: Craig Healy, Garden Grove, CA (US)

(72) Inventor: Craig Healy, Garden Grove, CA (US)

( * ) Notice: Subject to any disclaimer, the term of this patent is extended or adjusted under 35 U.S.C. 154(b) by 0 days.

(21) Appl. No.: 15/875,376

(22) Filed: Jan. 19, 2018

(51) Int. Cl.
*F41A 17/02* (2006.01)
*F41A 17/56* (2006.01)

(52) U.S. Cl.
CPC ..... *F41A 17/02* (2013.01); *F41A 17/56* (2013.01)

(58) Field of Classification Search
CPC ..... F41A 17/02; F41A 17/56; F41A 17/62
USPC ..... 42/70.04, 70.05
See application file for complete search history.

(56) References Cited

U.S. PATENT DOCUMENTS 2,453,190 A * 11/1948 Boscowitz ..... A44C 9/0069 63/1.12
4,105,885 A * 8/1978 Orenstein ..... F41A 17/063 200/42.02
4,926,574 A * 5/1990 Rieger ..... F41A 17/64 42/70.04
5,915,936 A * 6/1999 Brentzel ..... F41A 17/063 42/70.11
6,487,804 B1 * 12/2002 Petrella, Jr. ..... F41A 17/06 42/70.08
6,510,640 B2 * 1/2003 Strong ..... F41A 17/54 42/70.01
7,051,468 B2 * 5/2006 Glock ..... F41A 17/02 42/70.01
7,234,261 B2 * 6/2007 McGarry ..... F41A 17/02 42/70.05
8,418,391 B2 * 4/2013 Kemmerer ..... F41A 17/066 42/70.05

* cited by examiner

*Primary Examiner* — Bret Hayes
(74) *Attorney, Agent, or Firm* — Gulf Coast Intellectual Property Group

(57) ABSTRACT

A firearm safety system that is operable to inhibit the discharge of a firearm unless the user of the firearm is wearing a mechanical engagement member. The firearm safety system includes a button biasly mounted within the grip of the firearm. The button is movable intermediate a first position and a second position. Operably coupled to the button is a coupling means that is configured to operably couple the button to a sear lever of a firearm. The coupling means includes alternate configurations including cables or shafts that are configured to be movable upon depression of the button. The button is moved by a mechanical engagement member. The mechanical engagement member is a metal ring worn on the finger of the hand engaged with the grip of the firearm. As the mechanical engagement member depresses the button, the sear lever is moved so as to permit discharge of the firearm.

20 Claims, 2 Drawing Sheets

MECHANICAL FIREARM SAFETY SYSTEM

FIELD OF THE INVENTION

The present invention relates generally to firearms, more specifically but not by way of limitation, a firearm safety system that is operably intermediate the trigger of a firearm and the sear lever of the firearm wherein the firearm safety system inhibits firing of the weapon unless in the presence of a mechanical engagement member.

BACKGROUND

In the United States it is estimated that there are over three hundred and fifty million firearms. Firearms are generally divided into two categories of long guns, i.e. rifles and handguns. Approximately fifteen thousand people a year die from shooting each year in the United States. Accidental firearm deaths account for almost twenty five percent of firearm related deaths. All firearms have an intrinsic safety system with the most common being a safety button and/or lever. The safety button and/or lever inhibits the trigger from being completely depressed and thus discharging the firearm. These conventional features provide some safety from accidental discharge but typically only for those trained in handling firearms.

There are several types of accessories that can be installed on firearms in order to prohibit the unauthorized use thereof. Common safety devices for firearms include but are not limited to trigger locks. As is known in the art trigger locks are surroundably secured to the trigger of a firearm arm and require a key to remove in order to position the firearm ready for use. One issue with trigger locks is the inability for a user to quickly utilize a firearm if needed for self-defense. Alternate safety systems present similar challenges in providing the ability to render a weapon inoperable and yet provide the ability to rapidly utilize if required.

Accordingly, there is a need for firearm safety system that is operably intermediate the trigger and the hammer of a firearm wherein the safety system inhibits the ability for the firearm to be discharged unless in the presence of a mechanical engagement member that is worn by a user.

SUMMARY OF THE INVENTION

It is the object of the present invention to provide firearm safety system that is operably intermediate the trigger and the hammer of a firearm wherein the firearm safety system prohibits the discharge of the firearm unless in the presence of an external mechanical engagement member.

Another object of the present invention is to provide a firearm safety system that is operable to inhibit the firing of a weapon unless a user has a mechanical engagement member wherein the mechanical engagement member is being worn by a user.

A further object of the present invention is to provide a firearm safety system that is operably intermediate the trigger and firing mechanism of a firearm that further includes a biasly mounted button incorporated into the grip of the firearm.

Still another object of the present invention is to provide a firearm safety system that is operable to inhibit the firing of a weapon unless a user has a mechanical engagement member that further includes a first ramp member operably coupled to the biasly mounted button.

An additional object of the present invention is to provide a firearm safety system that is operably intermediate the trigger and firing mechanism of a firearm that further includes an adjustment shaft operably coupled to the first ramp member distal to the biasly mounted button.

Yet a further object of the present invention is to provide a firearm safety system that is operable to inhibit the firing of a weapon unless a user has a mechanical engagement member that further includes wherein the adjustment shaft further includes a second ramp member operably coupled to the adjustment shaft.

Another object of the present invention is to provide a firearm safety system that is operably intermediate the trigger and firing mechanism of a firearm that further includes wherein the second ramp member is operably coupled to a sear lever.

Still an alternate objective of the present invention is to provide a firearm safety system that is operable to inhibit the firing of a weapon unless a user has a mechanical engagement member wherein the adjustment shaft is biasly mounted utilizing a spring or similar element.

An additional object of the present invention is to provide a firearm safety system that is operably intermediate the trigger and firing mechanism of a firearm that further includes an alternative embodiment means of mechanically coupling the firearm trigger and the sear lever.

To the accomplishment of the above and related objects the present invention may be embodied in the form illustrated in the accompanying drawings. Attention is called to the fact that the drawings are illustrative only. Variations are contemplated as being a part of the present invention, limited only by the scope of the claims.

BRIEF DESCRIPTION OF THE DRAWINGS

A more complete understanding of the present invention may be had by reference to the following Detailed Description and appended claims when taken in conjunction with the accompanying Drawings wherein:

DETAILED DESCRIPTION

Figure 2:
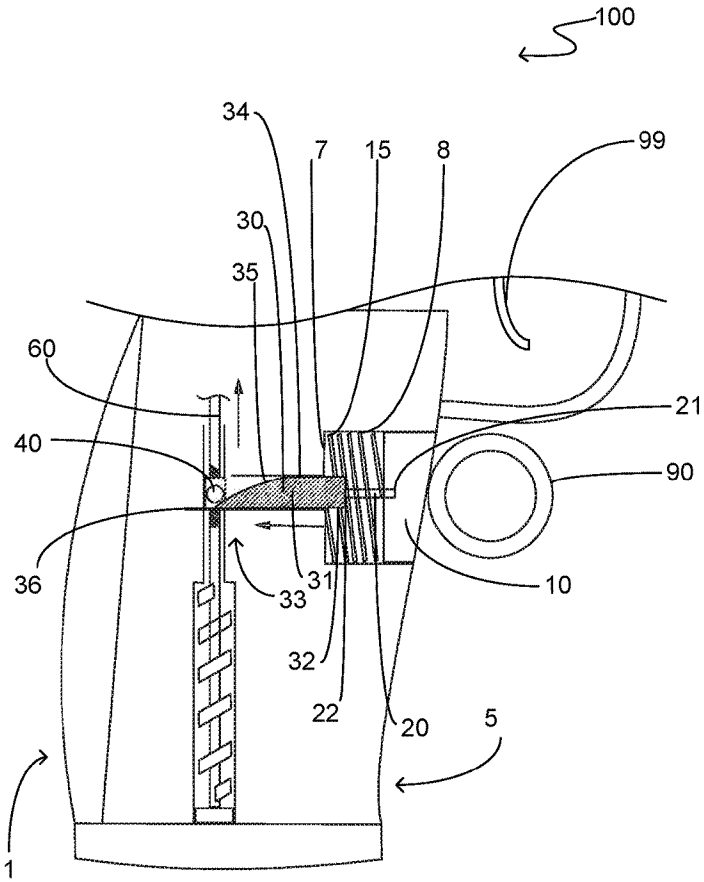
FIG. 2 is a side cross-sectional view of an embodiment of the present invention.

Referring now to the drawings submitted herewith, wherein various elements depicted therein are not necessarily drawn to scale and wherein through the views and figures like elements are referenced with identical reference numerals, there is illustrated an firearm safety system 100 constructed according to the principles of the present invention.

An embodiment of the present invention is discussed herein with reference to the figures submitted herewith. Those skilled in the art will understand that the detailed description herein with respect to these figures is for explanatory purposes and that it is contemplated within the scope of the present invention that alternative embodiments are plausible. By way of example but not by way of limitation, those having skill in the art in light of the present teachings of the present invention will recognize a plurality of alternate and suitable approaches dependent upon the needs of the particular application to implement the functionality of any given detail described herein, beyond that of the particular implementation choices in the embodiment described herein. Various modifications and embodiments are within the scope of the present invention.

It is to be further understood that the present invention is not limited to the particular methodology, materials, uses and applications described herein, as these may vary. Furthermore, it is also to be understood that the terminology used herein is used for the purpose of describing particular embodiments only, and is not intended to limit the scope of the present invention. It must be noted that as used herein and in the claims, the singular forms "a", "an" and "the" include the plural reference unless the context clearly dictates otherwise. Thus, for example, a reference to "an element" is a reference to one or more elements and includes equivalents thereof known to those skilled in the art. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures. Language that may be construed to express approximation should be so understood unless the context clearly dictates otherwise.

References to "one embodiment", "an embodiment", "exemplary embodiments", and the like may indicate that the embodiment(s) of the invention so described may include a particular feature, structure or characteristic, but not every embodiment necessarily includes the particular feature, structure or characteristic.

Figure 1:
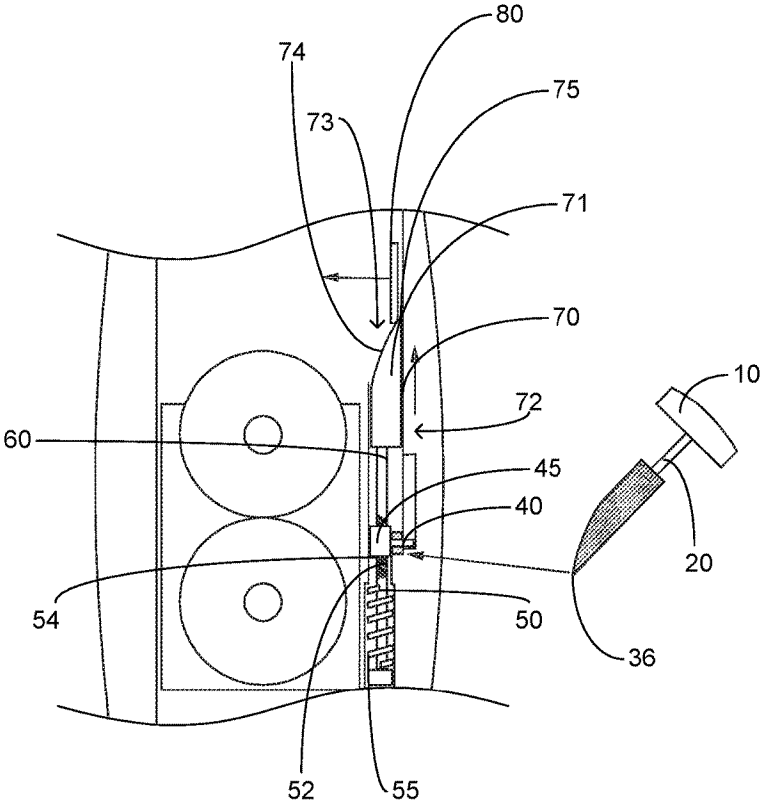
FIG. 1 is an end cross-sectional view of an embodiment of the present invention.

Referring in particular to FIG. 1 and FIG. 2 herein, the firearm safety system 100 includes button 10. Button 10 is manufactured from a durable rigid material such as but not limited to plastic or metal and is movably mounted within the grip 5 of a firearm 1. The button 10 is movably mounted within the grip 5 utilizing spring 15. Spring 15 and button 10 are mounted within void 8 of the grip 5 and retained therein utilizing suitable techniques. The spring 15 functions to provide an inward-outward movement of the button 10 and is biased against the inner surface 9 of the button 10 placing a biased outward force thereon. While the spring 15 is illustrated herein as being a coil spring, it is contemplated within the scope of the present invention that the spring 15 could be manufactured from various alternate types of biasing elements such as but not limited to a leaf spring. It is contemplated within the scope of the present invention that the button 10 could be placed in alternate positions on the grip 5. It should be further understood that the button 10 could be manufactured in alternate sizes and shapes.

Operably coupled to the inner surface 9 of button 10 is rod member 20. Rod member 20 is a conventional rod manufactured from metal or other suitable material and is secured perpendicular to the button 10 extending inwards towards the rear wall 7 of the void 8. Rod member 20 includes first end 21 and second end 22. While the rod member 20 is illustrated herein operably coupling the button 10 to the first ramp member 30, it is contemplated within the scope of the present invention that the first ramp member 30 could be integrally formed with the button 10. Secured to second end 22 of rod 20 is first ramp member 30. First ramp member 30 is secured to the second end 22 of the rod member 20 utilizing suitable durable techniques. The first ramp member 30 is manufactured from a durable material such as but not limited to metal. The first ramp member 30 includes a body 31 that is generally rectangular in shape having a first end 32 and second end 33. The body 31 includes an upper surface 34 having a sloped portion 35 wherein the sloped portion is proximate the second end 33. The sloped portion 35 is formed at an angle so as to create tip 36 present at the second end 33 of the body 31. The tip 36 is formed in conjunction with the sloped portion 35 of the upper surface 34 so as to facilitate the slidable engagement with pin 40.

Pin 40 is secured to mounting block 45 utilizing suitable durable techniques and is perpendicular thereto. Mounting block 45 is secured to the adjustment shaft 50. Adjustment shaft 50 is biasly secured within the grip 5 utilizing spring 55. The second end 52 of the adjustment shaft 50 has threads 54 thereon providing a movable coupling to mounting block 45. Adjustment shaft 50 is vertically adjustable utilizing threads 54 so as to provide adjustment of the travel distance of the adjustment shaft 50. An upper portion 60 of the adjustment shaft 50 is extends upward from the mounting block 45. Secured to the upper portion 60 of the adjustment shaft 50 is the second ramp member 70. The second ramp member 70 is formed similarly to the first ramp member 30 having a body 71 generally rectangular in shape. The body 71 includes first end 72 and second end 73 and further has a sloped upper surface 74. Sloped upper surface 74 has a slope so as to form a tip 75 proximate the second end 73 of the body 71. Tip 75 is formed so as to facilitate a slidable engagement with a sear lever 80. It is contemplated within the scope of the present invention that tip 75 could be formed in alternate shapes and sizes in order to operably engage a sear lever of a firearm.

Referring to FIG. 2, the mechanical engagement member 90 is illustrated therein. The mechanical engagement member 90 is worn by a user and is configured so as to operably engage with the button 10 facilitating the depression thereof in order to allow discharge of the firearm 1 as will be further discussed herein. The preferred embodiment of the mechanical engagement member 90 is a ring that is worn on the finger of a user wherein upon engaging the grip 5 the mechanical engagement member 90 depresses the button 10. The mechanical engagement member 90 is manufactured from a durable material such as but not limited to metal and is further manufactured in alternate thickness. Providing alternate thicknesses of the mechanical engagement member 90 accommodates users having different hand sizes in order to achieve sufficient depression of the button 10 permitting discharge of the firearm 1. While the mechanical engagement member 90 is illustrated herein as being a ring, it is contemplated within the scope of the present invention that the mechanical engagement member 90 could be manufactured in alternate shapes, sizes and structures and still achieve the desired functionality described herein. It is further contemplated within the scope of the present invention that the mechanical engagement member 90 could further be operably coupled to alternate firearm accessories in order to facilitate the simultaneous engagement thereof. More specifically but not by way of limitation, the mechanical engagement member 90 could be operably coupled to a light or target laser and provide activation thereof during depression of the button 10.

A description of the operation of the firearm safety system 100 is as follows. In use, a user will don the mechanical engagement member 90 on a desired finger and engage the grip 5 of the firearm 1. As the user engages the grip 5, the mechanical engagement member 90 operably couples to button 10 providing depression thereof. As the button 10 is moved to a depressed position, the rod member 20 traverses in the same direction and as such the first ramp member 30 moves inward. As the first ramp member 30 moves inward the tip 36 engages pin 40 wherein the pin 40 traverses adjacent the sloped portion 35 of the upper surface 34. As the pin 40 traverses along sloped surface 35 the block 45 is forced upward and as such the adjustment shaft 60 is biased in an upward direction. As the adjustment shaft 60 is biased upwards the second ramp member 70 moves in the same direction so as to facilitate the operable engagement with sear lever 80. As the second ramp member 70 continues its upward movement the sear lever 80 is moved laterally so as to engage a hammer (not illustrated herein) and subsequent the lateral movement of the sear lever 80 the hammer (not illustrated) herein is operably coupled to trigger 99 so as to place the firearm 1 in an operable mode allowing the discharge thereof. It should be understood that the firearm safety system 100 could be physically oriented in alternate directions and as such direction movement descriptions described herein correlate with the exemplary embodiment provided in the illustrations. Movement directions such as but not limited to upwards and laterally could be in alternate direction depending upon the manner in which the firearm safety system 100 is mounted within a firearm 1.

Figure 3:
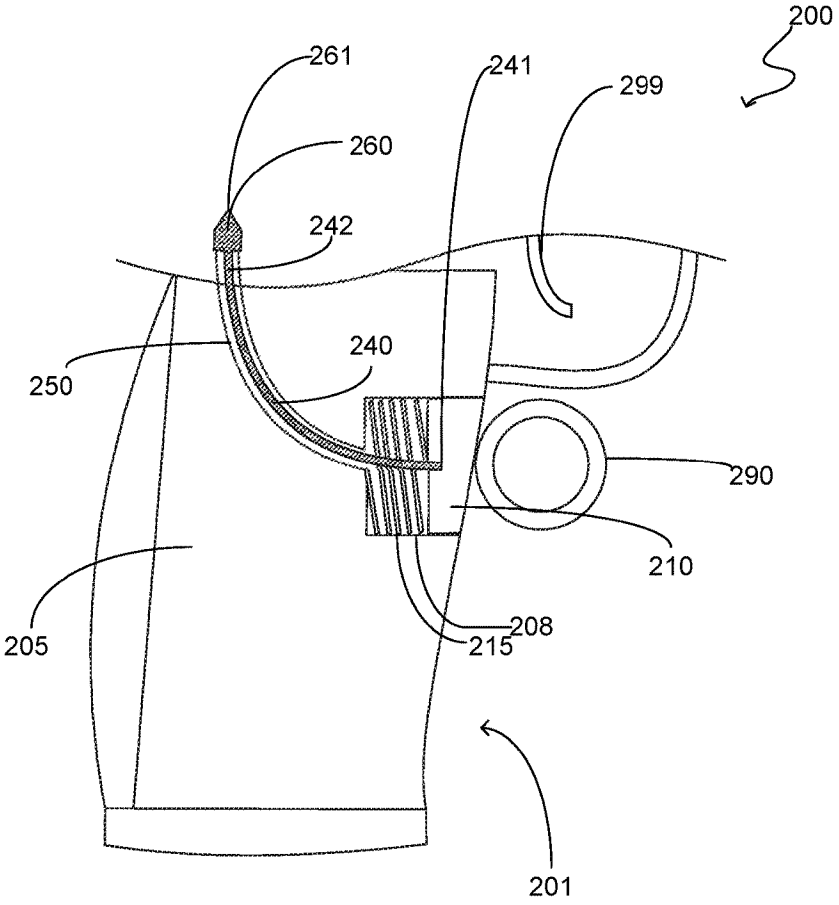
FIG. 3 is side cross sectional view of an alternative embodiment of the present invention.

Referring in particular to FIG. 3 herein, an alternative embodiment of the firearm safety system 200 is illustrated therein. The firearm safety system 200 includes button 210 biasly mounted within void 208 utilizing spring 215. This is identical to embodiment of the firearm safety system 100 having button 10 and spring 15. The firearm safety system 200 includes cable 240 having a first end 241 and second end 242. Cable 240 is manufactured from a bendable but rigid material such as but not limited to metal. The first end 241 of the cable 240 is secured to button 210 utilizing suitable durable techniques. The cable 240 is journaled through a hollow passage 250 present in grip 205. Secured to the second end 242 of the cable 240 is tip 260. Tip 260 includes triangular shaped upper end 261 wherein the aforementioned shape promotes a slidable engagement with a sear lever (not illustrated herein) facilitating the movement of a sear lever in order to permit the operation of a hammer (not illustrated herein) so as to discharge the firearm 201. It is further contemplated within the scope of the present invention that tip 260 could be formed in alternate shapes and/or sizes so as to operably engage a sear lever of a firearm. Upon engagement of the mechanical engagement member 290 with button 210, the button 210 is biased in an inward direction facilitating the movement of cable 240. As cable 240 moves from a first position to a second position the tip 260 engages a sear lever (not illustrated herein) of the firearm 201 so as to operably couple the trigger 299 and the hammer (not illustrated herein) permitting the discharge of the firearm 201. While a cable 240 has been illustrated herein, it is contemplated within the scope of the present invention that the alternate materials and/or elements could be utilized in place of and/or in conjunction with the cable 240 in order to facilitate the operable coupling of the trigger 299 and a hammer (not illustrated herein) of the firearm 201.

In the preceding detailed description, reference has been made to the accompanying drawings that form a part hereof, and in which are shown by way of illustration specific embodiments in which the invention may be practiced. These embodiments, and certain variants thereof, have been described in sufficient detail to enable those skilled in the art to practice the invention. It is to be understood that other suitable embodiments may be utilized and that logical changes may be made without departing from the spirit or scope of the invention. The description may omit certain information known to those skilled in the art. The preceding detailed description is, therefore, not intended to be limited to the specific forms set forth herein, but on the contrary, it is intended to cover such alternatives, modifications, and equivalents, as can be reasonably included within the spirit and scope of the appended claims.

What is claimed is:

1. A firearm safety system that is configured to inhibit the discharge of a firearm unless certain parameters are achieved comprising:

a button, said button being operably mounted into a grip of a firearm, said button being biasly mounted within a void in the grip, said button having a first position and a second position;

a coupling means, said coupling means being operably coupled intermediate said button and a sear lever of the firearm, said coupling means being movable by said button, said coupling means configured to move the sear lever into a position wherein the firearm can be discharged;

a mechanical engagement member, said mechanical engagement member being external to the firearm, said mechanical engagement member being worn on a hand of a user of the firearm, said mechanical engagement member being positioned so as to engage said button; and wherein upon said mechanical engagement member engaging with and moving said button to said second position said coupling means moves said sear lever into a position such that the firearm can be discharged.

2. The firearm safety system as recited in claim 1, wherein the button is biasly mounted within the void utilizing a spring.

3. The firearm safety system as recited in claim 2, wherein the mechanical engagement member is a ring worn on a finger of the hand of the user.

4. The firearm safety system as recited in claim 3, wherein the mechanical member is manufactured in alternate thicknesses.

5. A firearm safety system that is configured to inhibit a firearm from discharging until being mechanically engaged by an external element comprising:

a button, said button being movably mounted within a grip of the firearm, said button having a first position and a second position;

a cable, said cable having a first end and a second end, said first end of said cable being secured to said button, said cable being mounted within a passage in the grip of the firearm, said cable being movably secured within said passage, said second end of said cable being configured to operably engage a sear lever of the firearm;

a mechanical engagement member, said mechanical engagement member being configured to be worn on a hand of user, said mechanical engagement member being worn on the hand of the user so as to engage said button upon the user utilizing the hand to grasp the grip of the firearm, said mechanical engagement member configured to move said button from said first position to said second position subsequent engagement therewith; and wherein ensuing the movement of said button to said second position, said cable engages the sear lever and moves to a position wherein the firearm can be discharged.

6. The firearm safety system as recited in claim 5, wherein the second end of said cable further includes an engagement tip, said engagement tip configured to operably couple to the sear lever.

7. The firearm safety system as recited in claim 6, and further including a spring, said spring being mounted within a void in the grip, said spring being operably coupled to said button, said spring facilitating the movement of said button intermediate said first position and said second position.

8. The firearm safety system as recited in claim 7, wherein said engagement tip is formed so as to operably engage the sear lever.

9. The firearm safety system as recited in claim 8, wherein the mechanical engagement member is annular in shape and configured to be worn on a finger of the hand of the user.

10. The firearm safety system as recited in claim 9, wherein the mechanical engagement member is manufactured in alternate thicknesses.

11. A firearm safety system configured to inhibit the discharge of a firearm unless a user of the firearm is wearing a mechanical engagement member wherein the firearm safety system comprises:

a button, said button being movably via a spring within a void of a grip of the firearm, said button having a first position and a second position, said button having an outer surface, said button having an inner surface, said inner surface disposed within the void, said inner surface operably coupled to said spring;

a first ramp member, said first ramp member being operably coupled to said button, said first ramp member being movable with said button, said first ramp member extending outward from said inner surface of said button;

an adjustment shaft, said adjustment shaft being disposed within the grip of the firearm, said adjustment shaft configured to be vertically movable, said adjustment shaft being biasly secured within the grip of the firearm, said adjustment shaft having a lower portion and an upper portion;

a second ramp member said second ramp member being secured to said upper portion of said adjustment shaft, said second ramp member being configured to operably engage a sear lever of the firearm;

a mechanical engagement member, said mechanical engagement member being configured to be worn on a hand of user, said mechanical engagement member being worn on the hand of the user so as to engage said button upon the user utilizing the hand to grasp the grip of the firearm, said mechanical engagement member configured to move said button from said first position to said second position subsequent engagement therewith.

12. The firearm safety system as recited in claim 11, wherein said first ramp member includes body, said body of said first ramp member having a first end and a second end, said first ramp member having an upper surface, said upper surface of said first ramp member having a sloped portion.

13. The firearm safety system as recited in claim 12, and further including a rod member, said rod member having a first end and a second end, said first end of said rod member being secured to said inner surface of said button, said second end of said rod member being secured to said first ramp member, said rod member configured to operably couple said button to said first ramp member.

14. The firearm safety system as recited in claim 13, wherein the mechanical engagement member is annular in shape and configured to be worn on a finger of the hand of the user.

15. The firearm safety system as recited in claim 14, and further including a mounting block, said mounting block operably coupled to said adjustment shaft intermediate said lower portion and said upper portion.

16. The firearm safety system as recited in claim 15, and further including a pin, said pin being secured to said mounting block, said pin being perpendicular to said mounting block and extending outward therefrom, said pin configured to operably engage with the sloped portion of the upper surface of said first ramp member.

17. The firearm safety system as recited in claim 16, wherein said second ramp member includes a sloped upper surface, said sloped upper surface of said second ramp member configured to operably engage the sear lever of the firearm.

18. The firearm safety system as recited in claim 17, wherein ensuing said button being moved to said second position, said pin traverses along a portion of said sloped portion of said upper surface of said first ramp member so as to move the adjustment shaft in an upwards direction.

19. The firearm safety system as recited in claim 18, wherein during vertical upward movement of the adjustment shaft said sloped upper surface of said second ramp member engages the sear lever and moves the sear lever to a position wherein the firearm can be discharged with the pull of a trigger.

20. The firearm safety system as recited in claim 19, wherein the mechanical member is manufactured in alternate thicknesses.

* * * * *